US006089965A

United States Patent [19]

Otawa et al.

[11] Patent Number: 6,089,965

[45] Date of Patent: Jul. 18, 2000

[54] POLISHING PAD

[75] Inventors: Kazuhiko Otawa; Toshiyuki Fukumoto, both of Osaka; Yasuaki Kawakami, Hyogo-ken, all of Japan

[73] Assignee: Nippon Pillar Packing Co., Ltd., Osaka, Japan

[21] Appl. No.: 09/351,161

[22] Filed: Jul. 12, 1999

[30] Foreign Application Priority Data

Jul. 15, 1998 [JP] Japan ..... 10-200013

[51] Int. Cl.[7] ..... B24B 37/04

[52] U.S. Cl. ..... 451/527

[58] Field of Search ..... 451/527, 526, 451/550, 921, 548

[56] References Cited

U.S. PATENT DOCUMENTS 2,188,365 1/1940 Lent et al. ..... 451/550
3,623,276 11/1971 Twigg ..... 451/550
5,470,273 11/1995 Mertens ..... 451/550
5,609,517 3/1997 Lofaro ..... 451/526
5,795,218 8/1998 Doan et al. ..... 451/526
5,860,851 1/1999 Beppu et al. ..... 451/505

*Primary Examiner*—Robert A. Rose
*Attorney, Agent, or Firm*—Griffin & Szipl, P.C.

[57] ABSTRACT

A polishing pad that can polish the surface of work pieces, such as semiconductor silicon wafers, with satisfactory results. Polishing pad $1_1$ is formed of a large number of resin polishing elements 11, all tubular with a very small diameter, inseparably bound together, outer peripheral surface to outer peripheral surface, with the axial direction tube end faces aligned on a plane, to form a plate structure 10 with two kinds of pores 12, 13, which are regularly positioned and run through the plate structure 10 in the thickness direction. Pad surface 1*a* of polishing pad $1_1$ is formed by the axial direction tube end faces of polishing elements 11 . . . . First pore 12 is the center pore in the polishing element 11. Second pore 13 is formed between the outer peripheral surfaces of the polishing elements 11 . . . .

4 Claims, 8 Drawing Sheets

POLISHING PAD

BACKGROUND OF THE INVENTION

This invention relates to polishing pads for polishing such materials as semiconductor silicon wafers to a high degree of smoothness.

With the miniaturization of integrated circuits (LSI), the surfaces of semiconductor silicon wafers are generally polished to a high degree of smoothness by chemical mechanical polishing (CMP). This chemical mechanical polishing is carried out using a surface polishing apparatus, for instance as shown in FIG. 13. The surface polishing apparatus has a rotary table 2 with a polishing pad 1 spread and fixed thereupon, a top ring installed over the rotary table 2 and movable vertically to hold a work piece 3 to be polished (such as a semiconductor silicon wafer), and a polishing solution nozzle 6 to supply a polishing solution (slurry) 5, with abrasive grains such as $SiO_2$ and $Al_2O_3$ suspended therein, onto the polishing pad 1. The apparatus works in this manner. Rotary table 2 and top ring 4 rotate independently of one another, with polishing solution 5 being supplied onto polishing pad 1 from polishing solution nozzle 6 and with top ring 4 pressing the surface to be polished, or the lower surface 3*a*, of the work piece 3 against the upper surface, or the polishing surface 1*a*, of the polishing pad 1. In this way, the work piece surface 3*a* is polished to a high degree of smoothness (specular surface), with the polishing solution 5 placed between the work piece surface 3*a* to be polished and the polishing pad surface 1*a*.

Among examples of polishing pads are one formed of nonwoven fabric with randomly arranged polyester fibers partially impregnated and hardened with polyurethane resin and another one made of a foam structured sheet of the urethane type such as a foam structured (porous) polyurethane sheet. Those kinds of pads, porous in structure with many fine pores scattered in the polishing pad surface, exhibit excellent polishing characteristics. Those pores are responsible for increased retention of the polishing solution on the polishing pad surface. The pores are also to work to keep the work piece from sticking to the polishing pad surface.

The problem with those prior art porous structured polishing pads is that the pores formed in the surface layer of the pad 1 including the polishing pad surface 1*a* are varied in size and irregular in position and arrangement (pore-arrangement pattern, i.e. positional relation between the pores). That contributes to a lowered polishing rate, increased non-uniformity in degree of polishing in a given work piece to be polished (the surface of a silicon wafer), faulty polishing or a damaged surface, and the like. Because of such non-uniform polishing performance, a good polished surface is difficult to obtain.

To illustrate further, the area 1*b* of the polishing pad surface 1*a* with which the work piece surface 3*a* to be polished comes into contact (work piece contact area 1*b*) moves as the rotary table 2 and the top ring 4 rotate. If the polishing pad surface is irregular in pore size and pore-arrangement pattern, the work piece contact area 1*b* of the polishing pad surface 1*a* will change in pore formation (number of pores, size, pattern, etc.) as it moves. Furthermore, the pore formation of the polishing pad surface 1*a* changes constantly in accordance with decrease in thickness of the pad as the polishing goes on. For example, as the polishing pad surface wears in the course of the polishing process, some shallow pores will disappear while other pores under the surface will come out. In this way, the polishing pad surface 1*a* changes in pore number, size, and pattern. Also, a polishing pad surface studded with shallow pores (including pores made shallow by wearing of the pad surface) could cause faulty polishing (resulting in a damaged polished surface) because abrasive grains and/or polishing dust, detained and accumulated in the shallow pores, could shave the polishing work piece surface 3*a* locally deep.

Thus prior art polishing pads formed of nonwoven fabrics, urethane-type foam-structured sheets, etc. have presented the problem that they would change in polishing characteristics of the pad-work piece contact area 1*b*, such as retention of polishing solution, polishing rate, and non-uniformity, during the course of the polishing process.

SUMMARY OF THE INVENTION

It is an object of the present invention to provide a polishing pad that can polish the surface of work pieces such as semiconductor silicon wafers with satisfactory results but without problems such as those encountered with prior art polishing pads discussed hereinabove.

The polishing pad of the present invention which solves those problems is a polishing pad comprising a large number of resin polishing elements, tubular or columnar with a very small diameter, inseparably bound together, outer peripheral surface to outer peripheral surface, with the axial direction end faces aligned on a plane, to form a plate structure with pores regularly positioned and arranged and passing therethrough in the axial direction. As used herein, the term "axial direction" means the longitudinal direction of the polishing elements and is a concept identical with the thickness direction of the polishing pad. The expression "outer peripheral surface" as used herein denotes the outer surface portion of the polishing element except for the axial direction end faces.

In those embodiments in which solid, bar-shaped, columnar polishing elements are used, the elements are put together in such a way as to form gaps extending in the axial direction (thickness direction of the polishing pad) between the outer peripheral surfaces of the elements. If the elements are solid, columnar in shape, for example, they are brought together, with outer peripheral surface in linear contact with each other in which the contact line extends in the axial direction. The elements are linked to each other with the contact areas alone bonded together to produce gaps between the outer peripheral surfaces—gaps isolated from each other by the linked lines (linear contact portions). Those gaps serve as polishing pad pores.

In those embodiments in which tubular polishing pad elements are used, the elements are bound together either in such a way as to form gaps as described above or not to form such gaps between the outer peripheral surfaces.

In the former case, the pores in that pad are those in the center of the respective elements and, in addition, the gaps formed between the elements. In the latter case, the pores are the center pores only.

The outer peripheral surfaces may be bound together by thermal fusion or with adhesive. The polishing pad of the present invention can also be bonded to a base formed of nonwoven fabrics, etc. as necessary. That is, the polishing pad comprises a plurality of layers with the respective layers placed one on another in the thickness direction, wherein the surface layer is formed of the plate structure which comprises a large number of tubular or columnar resin polishing elements bound together to form one piece.

DESCRIPTION OF PREFERRED EMBODIMENTS

Illustrative embodiments of the present invention will now be described with reference to FIGS. 1–13.

EXAMPLE 1

Figure 13:
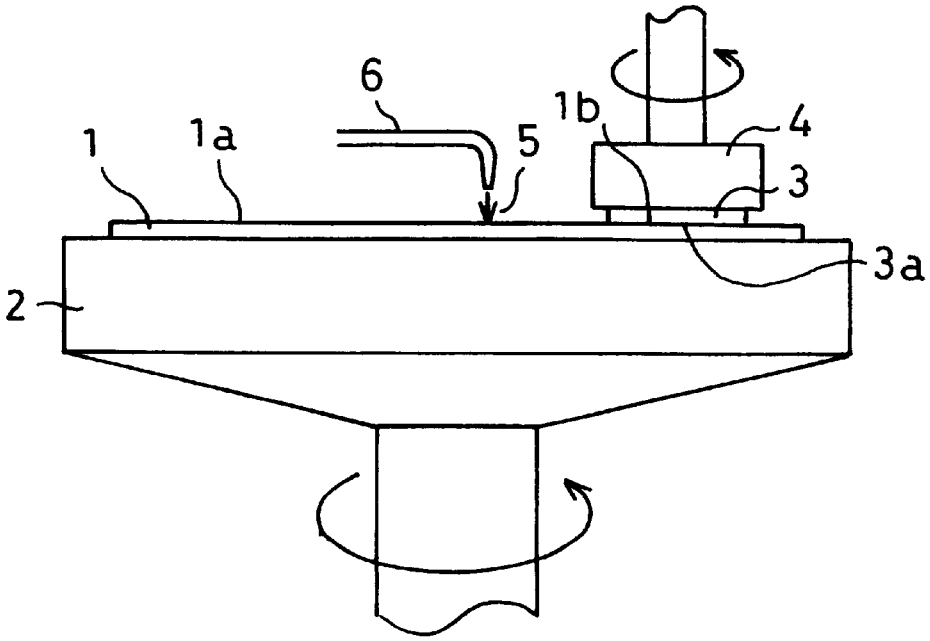
FIG. 13 is a side view of a typical surface polishing apparatus in which the polishing pad is mounted.

FIGS. 1–4 show a polishing pad for CMP as a first embodiment of the present invention. This is an example of application of the present invention to a polishing pad 1 which is spread and fixed on a rotary table 3 (directly bonded on the rotary table 2 or on the top of a surface plate mounted on the table 2) of the surface polishing apparatus as shown in FIG. 13.

The polishing pad (first pad $\mathbf{1}_1$) in this embodiment of the present invention is formed of a large number of resin polishing elements 11, all tubular with a very small diameter, inseparably bound together, outer peripheral surface to outer peripheral surface, with the axial direction tube end faces aligned on a plane, to form a plate structure 10 with pores 12 . . . , 13 . . . regularly positioned and arranged and passing through the plate in the thickness direction or the axial direction of the elements. This plate structure 10 is bonded on the rotary table 2 or on the top of a surface plate mounted on the table 2 of the surface polishing apparatus as shown in FIG. 13. With that arrangement, a work piece 3 to be polished, such as a semiconductor silicon wafer, can be polished on the surface with satisfactory results.

The polishing elements 11 . . . are cylindrical ultra-fine tubes or hollow fibers with an identical diameter and length—the length in the axial direction. Those polishing elements 11 are made of such materials as fluororesin or a polymer plastic (such as polypropylene, polyethylene, polyacetal, or urethane-type plastics). The material is chosen according to polishing conditions, such as the properties of the work piece 3 and the polishing solution 5, the hardness required of the polishing pad surface, and the like. If the polishing solution 5 is corrosive (acid, for example), a corrosion-resistant material such as fluororesin is used. The length of the polishing element 11 is set depending on the required thickness of the first pad $\mathbf{1}_1$ and others, but generally the length is preferably 1 to 15 mm.

Figure 1:
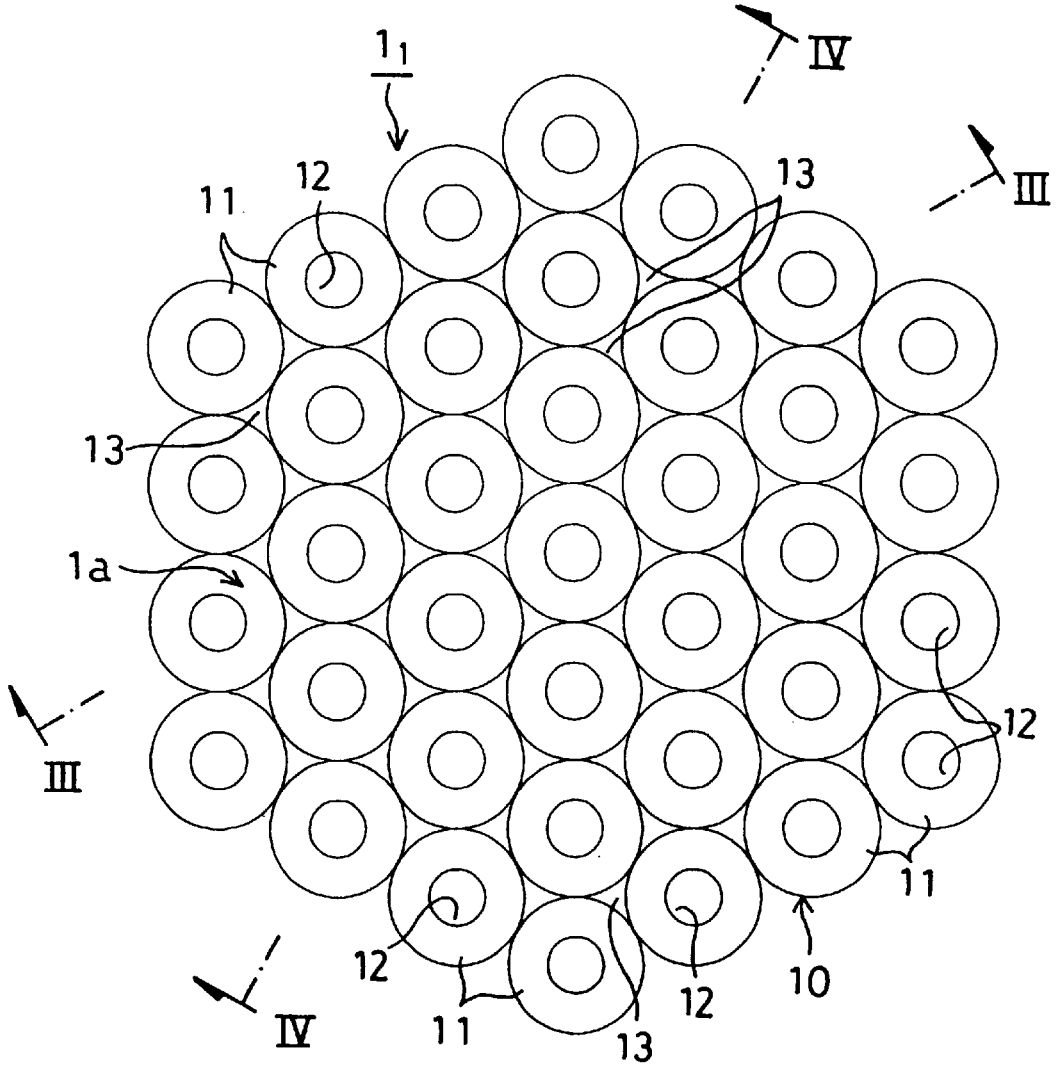
FIG. 1 is a top view of a polishing pad according to a first embodiment of the present invention.
Figure 2:
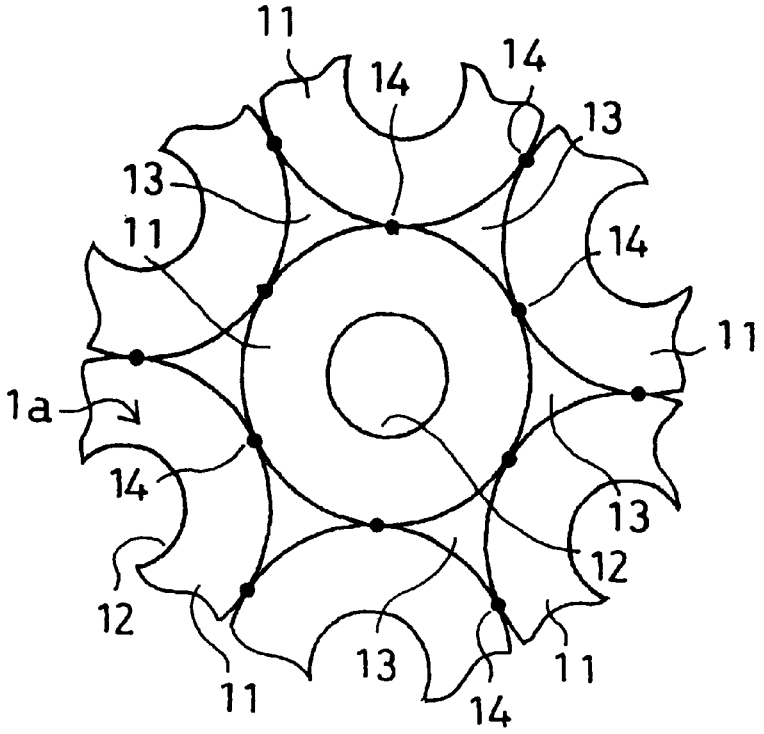
FIG. 2 is an enlarged view of the core part of FIG. 1.
Figure 3:
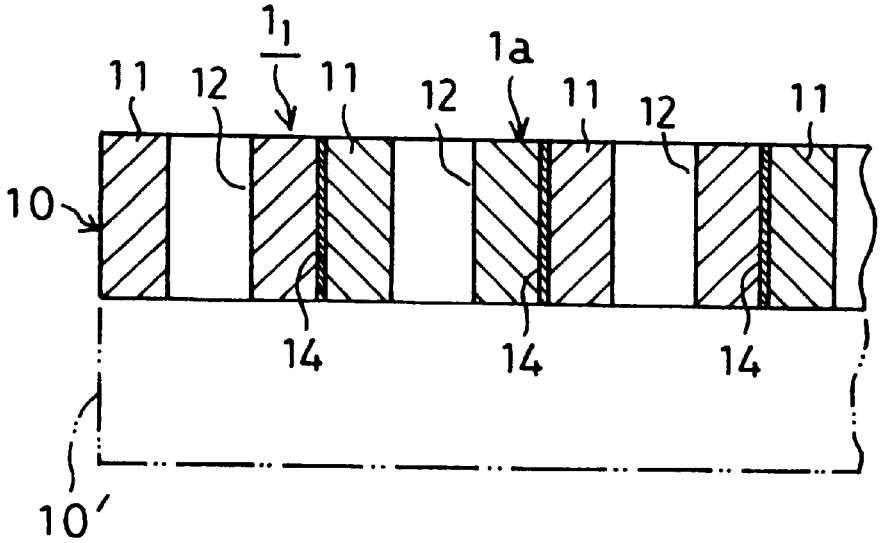
FIG. 3 is a vertical, sectional view of the core part taken on line III—III in FIG. 1.
Figure 4:
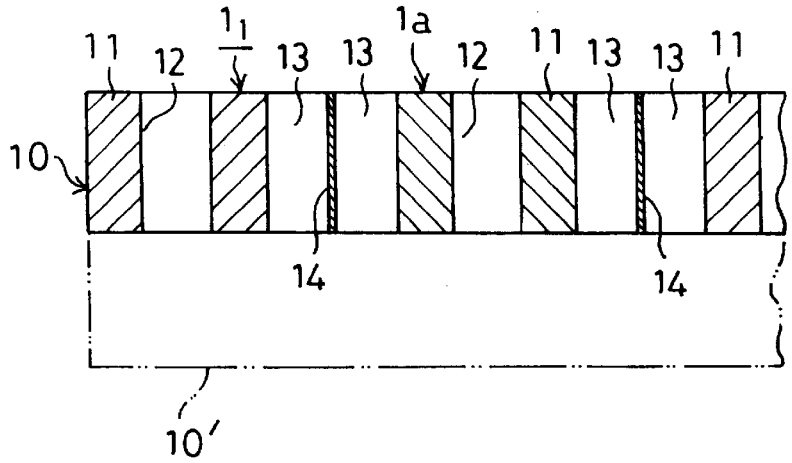
FIG. 4 is a vertical, sectional view of the core part taken on line IV—IV in FIG. 1.

The polishing elements 11 . . . are bonded into one piece, with the axial direction tube end faces aligned on a plane and with each one polishing element 11 brought into linear contact with six surrounding polishing elements 11 . . . in a zigzag or staggered pattern, as shown in FIG. 1. That is, the polishing elements 11 are bonded to each other at the linear contact areas, alone by thermal fusion or with an adhesive, to form a plate structure 10. The plate structure 10 has gaps 13 . . . isolated from each other by the bonded areas 14 . . . and formed between the outer peripheral surfaces, with the surface of the plate structure 10 formed with the axial direction tube end faces.

The first pad $\mathbf{1}_1$ comprising such a plate structure 10 has a polishing pad surface 1*a* formed with the tube end faces of the polishing elements 11 . . . , where a pore-arrangement pattern, that is, with two kinds of pores 12 . . . and 13 . . . , passes through the plate structure 10 in the axial direction. The pores are positioned and arranged regularly over the surface. The first pores 12 . . . are pores in the center of the tubular polishing elements 11 . . . , while the second pores 13 . . . are gaps formed between the outer peripheral surfaces and separated from each other by bonded area 14. Those pores, too, are positioned in a regular pattern. It is noted that the first pores 12 . . . have all the same cross-sectional shape and extend from one end face to the other in the thickness direction or the axial direction, as do the second pores 13 . . . In other words, the pore formation (number, size, arrangement, etc. of pores 12 . . . and pores 13 . . . ) is identical as seen at any cross-section, including the polishing pad surface 1*a*.

The inside diameter (pore size) and the wall thickness of the polishing element 11 determine the capacity of holding the polishing solution 5 (capacity of the first pore 12), polishing performance of the polishing pad surface 1*a*, etc. These diameters are set according to desired polishing conditions. For the following reasons, the inside diameter is preferably 0.02 to 3 mm and the wall thickness 0.5 to 2 mm.

That is, if the inside diameter of the polishing element 11 is less than 0.02 mm, the contact area between the polishing element 11 and the work piece 3 to be polished will be larger than necessary, and the polishing element 11 will fail to hold the required capacity of polishing solution 5. As a result, the contact area between the polishing element 11 and the work piece 3 tends to be in the state of boundary lubrication, making it difficult to polish the work piece surface 3*a* to a desired surface roughness. If, on the other hand, the inside diameter of the polishing element 11 exceeds 3 mm, the holder of polishing solution 5 (the first pore 12) becomes larger than necessary such that the contact area between the polishing element 11 and the work piece 3 tends to be in the state of fluid film lubrication. In such a state of fluid film lubrication, the polishing pad, topped with a thin coat of the polishing solution, could cut out very small protrusions on the work piece surface 3*a* but could not remove large protrusions (undulation on the work piece surface 3*a*) very well, thus failing to polish the work piece surface to a desired flatness.

Similarly, the second pore 13, which holds the polishing solution along with the first pore 12, is set in the same sectional area size range as the first pore 12 in the polishing element 11—the sectional area equivalent to that of the first pore 12 with an inside diameter of 0.02 to 3 mm. If the wall thickness of the polishing element 11 is less than 0.5 mm, the local pressing force applied on the work piece surface 3*a* to be polished becomes stronger than necessary, making it difficult to polish the work piece surface 3*a* uniformly. With a polishing element wall thickness of more than 2 mm, on the other hand, the overall rigidity of the pad rises more than necessary, which hinders smooth polishing of the work piece surface 3*a*. With such a polishing pad, the work piece surface is impossible to finish to a high degree of smoothness.

The number of polishing elements 11 . . . forming the plate structure 10 is set at 200 to 1,000,000, depending on such factors as the element diameter and the size of the first pad $\mathbf{1}_1$. The shape of the plate structure 10 can be chosen depending on the type of the rotary table 2 or the surface plate on which the first pad $\mathbf{1}_1$ is spread and fixed, but is generally hexagonal or circular. In the present example, a hexagonal shape is adopted as shown in FIG. 1.

The first pad $\mathbf{1}_1$ thus formed is uniform in pore formation in the polishing pad surface 1*a* of the pad $\mathbf{1}_1$ and in any cross-sectional face thereunder and is regular in pore arrangement pattern. With this pad $\mathbf{1}_1$, therefore, it is possible to carry out polishing with satisfactory results without such problems as lowered polishing rate, non-uniform amount of polished area in the work piece surface (wafer), and damaged polished surface.

In other words, there will be no change in pore formation (pore number, size, pattern, etc.) even when the work piece contact area 1*b* on the polishing pad surface 1*a*—the area on the polishing pad contact—moves as the rotary table 2 and the top ring 4 rotate, because the pores 12 . . . , 13 . . . in the polishing pad surface 1*a* are uniform and are regularly arranged and positioned. Being identical at any cross-sectional face including the polishing pad surface 1*a*, furthermore, the pore formation will stay uniform and unchanged as the pad wears and decreases in thickness as a result of conditioning or polishing. It is also noted that if the pores in the polishing pad surface are shallow (including the pores made more shallow as the pad surface has worn out), abrasive grains and polishing dust are caught and accumulated in those shallow pores (prior art). The abrasive grains and polishing dust could cause local scoring in the work piece surface. The polishing pad of the present invention is, however, free from damaging the work piece surface 3*a* and can produce a uniformly polished surface, because the pores 12 . . . , 13 . . . , being formed through the plate 10 in the pad thickness direction, are not made significantly shallower by wear.

The polishing pad surface 1*a* should also have physical and chemical properties in accordance with the polishing conditions (properties of the work piece, polishing solution, and so on). Those requirements can be easily met by choosing a suitable material for the polishing element 11. The polishing pad surface 1*a* does not change in physical and chemical properties as the pad surface wears out.

Thus the polishing pad surface 1*a* and the work piece contact area 1*b* on the polishing pad surface 1*a* undergo no changes in capacity of holding the polishing solution, polishing rate and uniformity, etc. as the polishing process progresses. That is, there will occur no non-uniformity in polishing performance. In addition, since the polishing characteristics can be maintained at a fixed level, it is possible to properly control the polishing process on the basis of such limited factors as polishing time. This way, it is possible to provide an optimum polishing meeting the requirements imposed on the work piece.

EXAMPLE 2

FIGS. 5 to 8 show a second embodiment of the present invention. In this example as in the first embodiment, the present invention is applied to a polishing pad 1 which is to be spread and fixed on a rotary table 2 (directly bonded on the rotary table or on the top of a surface plate mounted on the table) of the surface polishing apparatus, as shown in FIG. 13.

The polishing pad in the second embodiment of the present invention (second pad $\mathbf{1}_2$) comprises a large number of resin polishing elements 20, all solid bar-like, columnar in shape with a very small diameter, inseparably bound together, outer peripheral surface to outer peripheral surface, with the axial direction bar end faces aligned on a plane, to form a plate structure 20 in such a way that gaps formed between the outer peripheral surfaces constitute pores 23 extending in the axial direction, as shown in FIGS. 5 to 8. Those pores 23 are regularly positioned and arranged. This plate structure 20 is bonded on the rotary table 2 or on the top of a surface plate mounted on the table 2 of the surface polishing apparatus, as shown in FIG. 13. With that arrangement, a work piece 3, such as a semiconductor silicon wafer, can be polished on the surface with satisfactory results.

The polishing elements 21 . . . are solid, bar-like, columnar fibers or linear bodies, all with the same diameter and the same length (length in the axial direction). Those polishing elements 21 are made of such materials as fluororesin or a polymer plastic (such as polypropylene, polyethylene, polyacetal, or urethane-type plastics)—the same materials for the element 11 of the first pad $\mathbf{1}_1$. A choice is made according to the polishing conditions, such as the properties of the work piece 3 and the polishing solution 5. The diameter (outside diameter) of the polishing element 21 is set according to the polishing conditions. Generally, the outside diameter is preferably 0.5 to 3 mm for the same reason that the wall thickness of the tubular polishing element 11 is set at 0.5 to 2 mm. The length of the polishing element 21 is generally set at preferably 1 to 5 mm, depending on such factors as the thickness of the second pad $\mathbf{1}_2$, as in the case of the aforesaid polishing element 11.

The polishing elements 21 . . . are bonded into one piece, with the axial direction end faces of the elements 21 . . . aligned on a plane and with each polishing element 21 brought into linear contact, outer peripheral surface to outer peripheral surface, with six surrounding polishing elements 21 . . . to form a zigzag, staggered pattern, as shown in FIGS. 5 to 8. That is, the polishing elements 21 are bonded to each other at the linear contact areas, alone by thermal fusion or with an adhesive, into a plate structure 20. The plate structure 20 has gaps 23 . . . which are formed between the outer peripheral surfaces and isolated from each other by the bonded areas 24 . . . , with the frontal surface of the structure 24 formed by the axial direction end faces of the elements 21 . . . .

The second pad $\mathbf{1}_2$ comprising such a plate structure 20 has a polishing pad surface 1*a* formed of the end faces of the polishing elements 21 . . . with a pore arrangement pattern in which pores 23 of one kind pass through the plate 20 in the axial direction and are arranged regularly over the surface. Those pores 23 . . . are gaps formed between the outer peripheral surfaces of the elements and are partitioned from each other by bonded linear areas. Those pores are positioned and arranged in the polishing pad surface 1*a* in a regular pattern. It is also noted that the pores 23 . . . have the same cross-section, and extend from one end face to the other in the thickness direction (the axial direction). In other words, the pore formation (number, size, arrangement, etc. of pores 23 . . . ) is identical as seen at any cross-section, including the polishing pad surface 1*a*. In this connection, it is preferred that the size of a pore 23 should be equivalent to that of the pores 12, 13 in the first polishing pad $\mathbf{1}_1$ for the same reason as that for which the inside diameter of the aforesaid polishing element 11 has been set.

Figure 5:
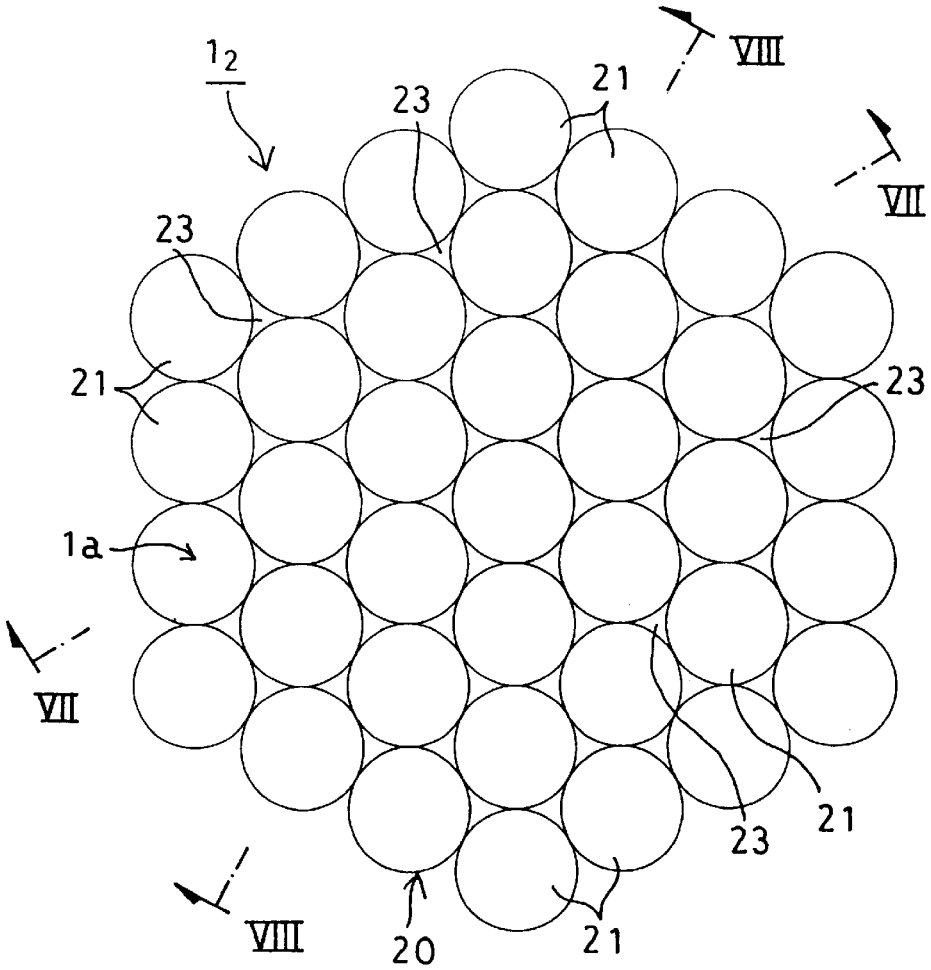
FIG. 5 is a top view of a polishing pad according to a second embodiment of the present invention.
Figure 6:
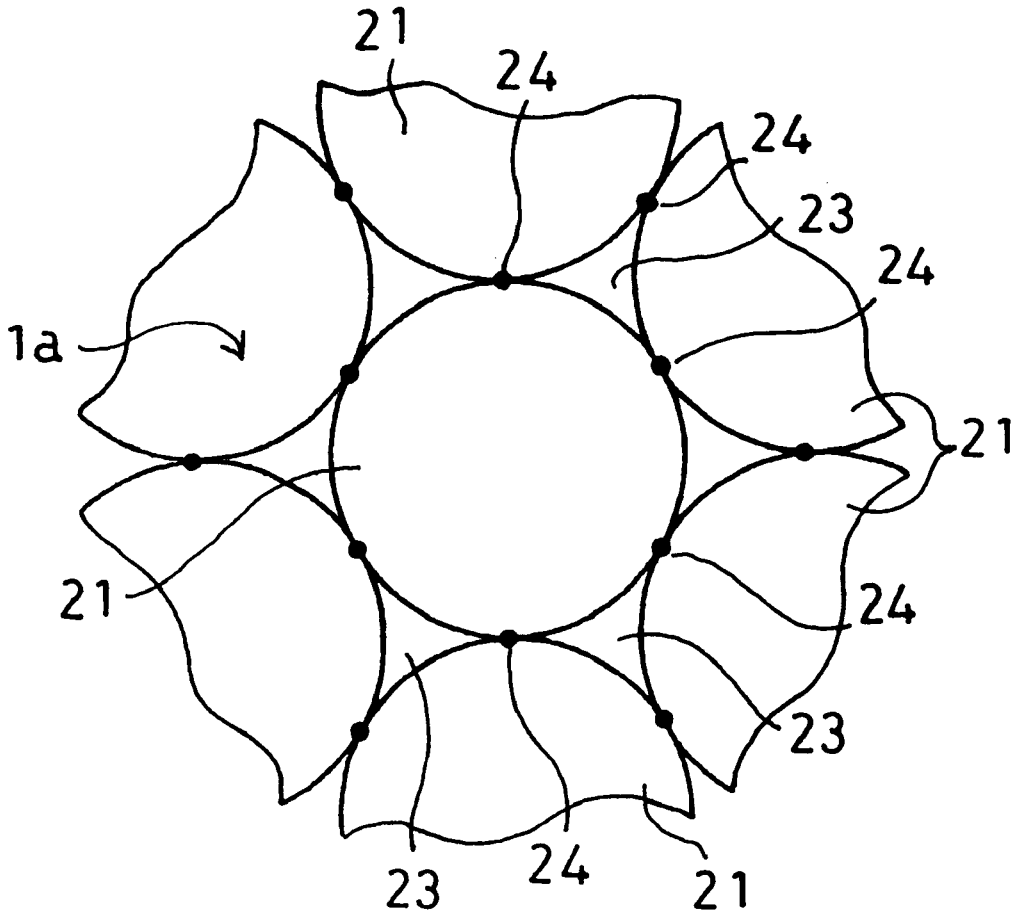
FIG. 6. is an enlarged view of the core part of FIG. 5.
Figure 7:
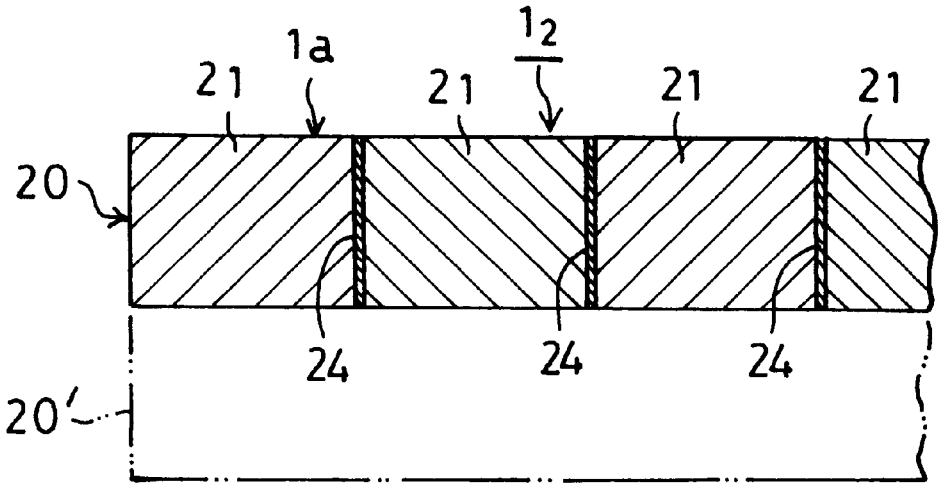
FIG. 7 is a vertical, sectional view of the core part taken on line VII—VII in FIG. 5.
Figure 8:
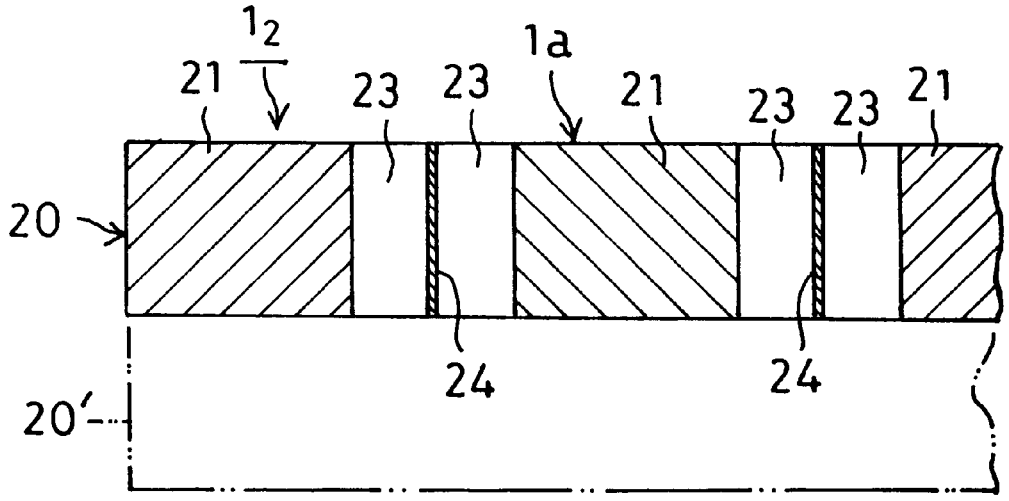
FIG. 8 is a vertical, sectional view of the core part taken on line IV—IV in FIG. 5.

The number of polishing elements 21 . . . forming the plate structure 20 is set at 200 to 1,000,000, depending on such factors as the element diameter and the size of the second pad $1_2$. The shape of the plate structure 20 can be chosen depending on the form of the rotary table 2 or the surface plate on which the second pad $1_2$ is spread and fixed, but is generally hexagonal or circular. In the present example, a hexagonal shape is adopted, as shown in FIG. 5.

Like the first pad $1_1$, the second pad $1_2$ thus formed is uniform in pore formation in the surface layer including the polishing pad surface 1*a* of the pad $1_2$ and is regular in pore arrangement pattern. With this pad $1_2$, therefore, it is possible to accomplish polishing with satisfactory results and without such problems as lowered polishing rate, non-uniform polishing amount in the work piece surface (wafer), and damaged polished surface.

Further Embodiments

It is understood that the present invention is not limited to the embodiments just described above, but may be changed or modified without departing form the spirit and scope of the present invention.

Figure 9:
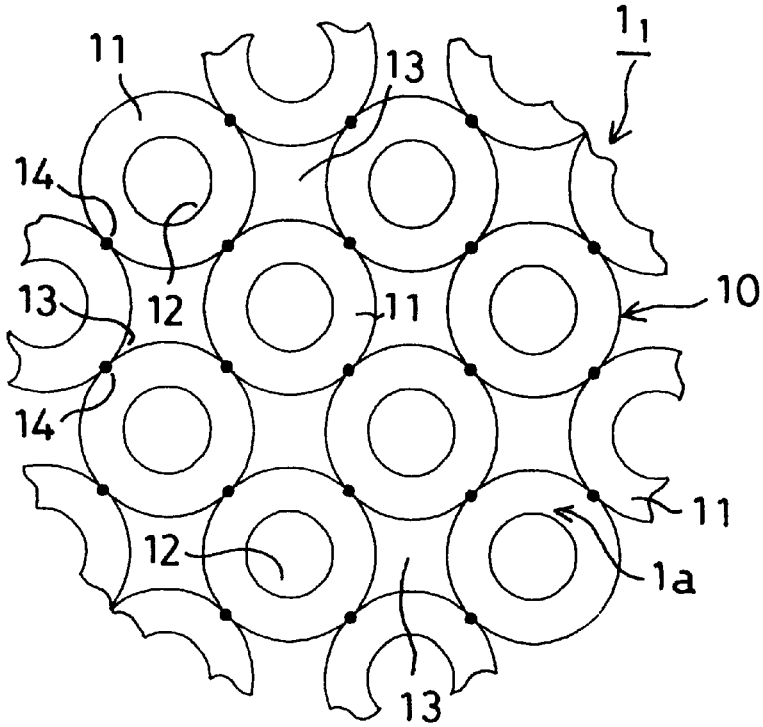
FIG. 9 is a top view of a variation of the polishing pad.
Figure 10:
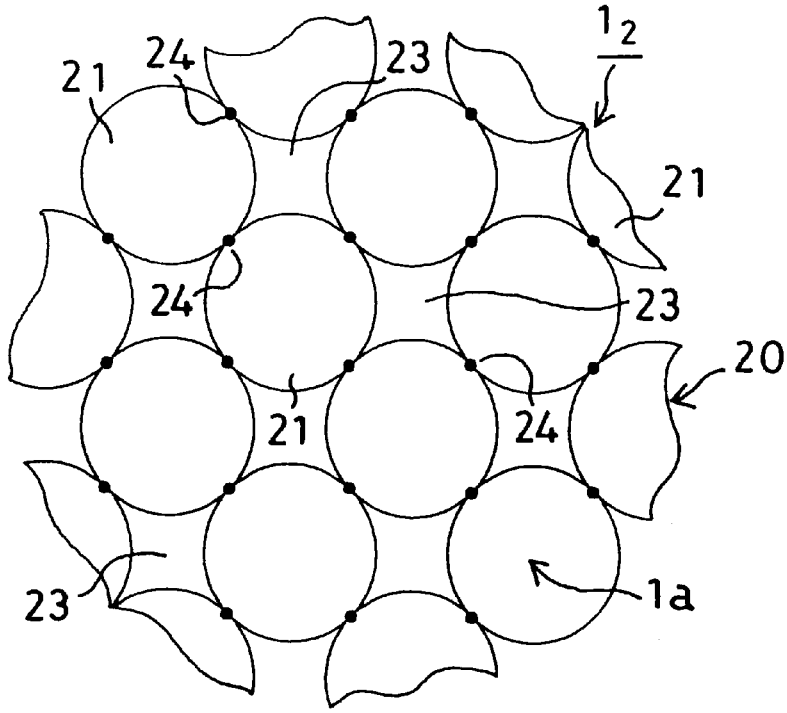
FIG. 10 is a top view of another variation of the polishing pad.

For example, the polishing elements 11, 21 making up the first pad $1_1$ or the second pad $1_2$ may be bonded, outer peripheral surface to outer peripheral surface, in any way. The polishing elements 11 . . . , 21 . . . may be bound into one piece, each polishing element 11, 21 in linear contact with four surrounding polishing elements 11 . . . , 21 . . . in a checked pattern, as shown in FIGS. 9 and 10, for example. The polishing element 11, 21 may be in any shape (cross-sectional shape), and is not limited to a tubular shape and a columnar shape circular in cross-section.

The sole exception is columnar polishing elements with specific cross-sectional shapes that can be bound together into one piece only in such a way that no through gaps, or pores, are formed in the axial direction between the outer peripheral surfaces. An example of that is a plate structure formed by putting together, in a honeycomb pattern, hexagonal, columnar, bar-like polishing elements that are solid. These solid, hexagonal elements do not then form through pores in the axial direction, and this poreless structure is, therefore, excluded. On the other hand, if hexagonal polishing elements that are tubular are bound together into a plate structure in a honeycomb pattern with no gaps formed between the outer peripheral surfaces, the center pores in the polishing elements are left open to form pores, and thus a plate structure in accordance with the present invention is formed.

The bonding strength with which the outer peripheral surfaces are linked is enough if the bonding is strong enough that the polishing elements 11 . . . , 21 . . . will not come off in polishing. For example, it will be acceptable if the linear contact areas 14, 24 are bonded in part instead of being bonded over the entire line from one end face to the other by thermal fusion.

Also, plate structures 10, 20 may be formed with a plurality of kinds of polishing element with different cross-sections or end faces so long as one or more kinds of pores 12 . . . , 13 . . . , 23 . . . formed in those polishing elements are arranged regularly. In such a case, polishing elements of different materials may be used as necessary.

Figure 11:
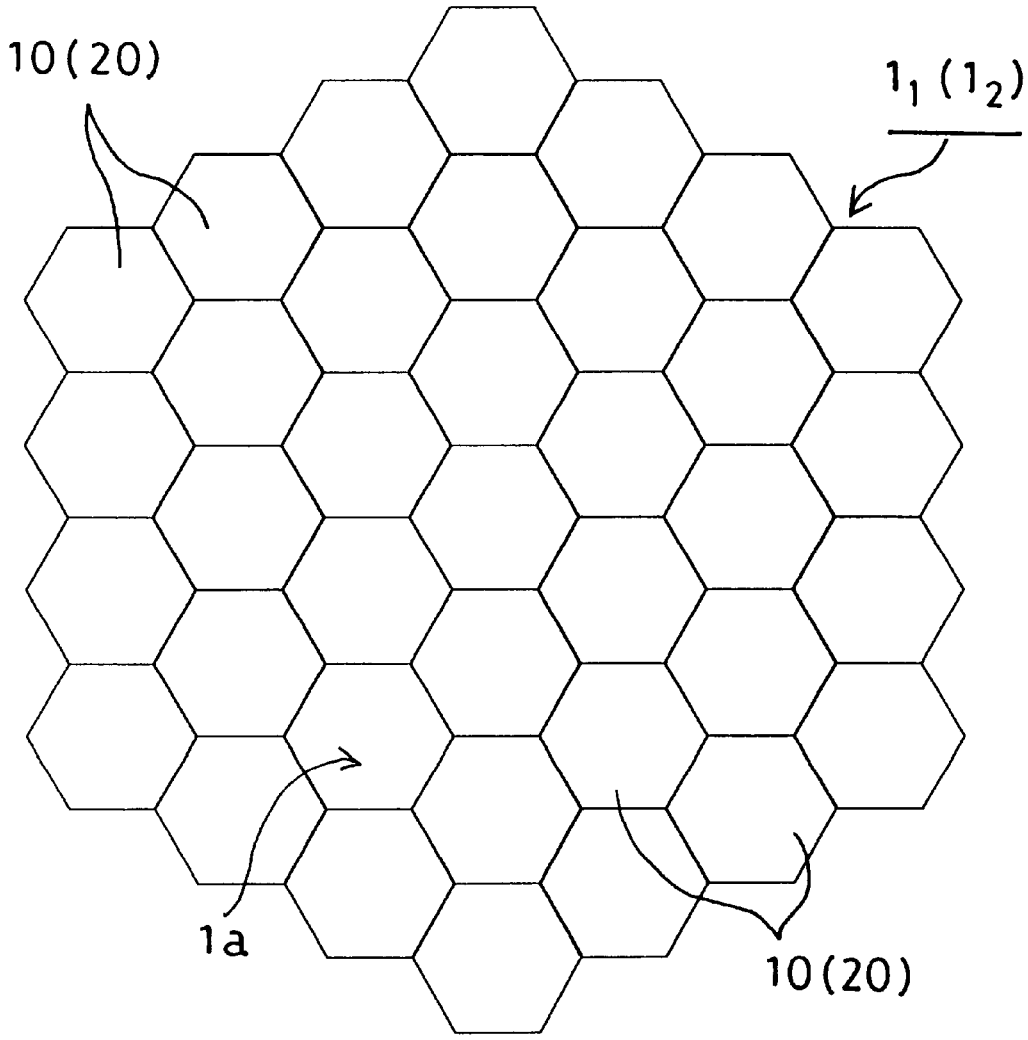
FIG. 11 is a top view of still another variation of the polishing pad.

In the preceding examples, the first pad $1_1$ or the second pad $1_2$ is formed by binding and bonding together a large number of polishing elements 11 . . . or 12 . . . into a plate structure 10 or 20. A plurality of such plate structures 10 . . . , 20 . . . may be arranged on the same plane side by side and bonded to form the pad. FIG. 11 shows such an example in which a plurality of plate structures 10 . . . or 20 . . . , each formed by binding polishing elements 11 . . . or 12 . . . into a hexagon, are bonded into one piece in a honeycomb pattern by thermal fusion. This way, it is possible to reduce the number of constituent elements for each plate structure 10 or 20 (down to a range of 10 to 10,000). This method is simpler than forming one pad $1_1$ or $1_2$ with one plate structure 10 or 20. Needless to say, a large polishing pad is easier to make that way, too. In this case, plate structures 10 . . . , 20 . . . of different materials and constructions (pore formation, etc.) also may be bonded together into one piece, as necessary.

Figure 12:
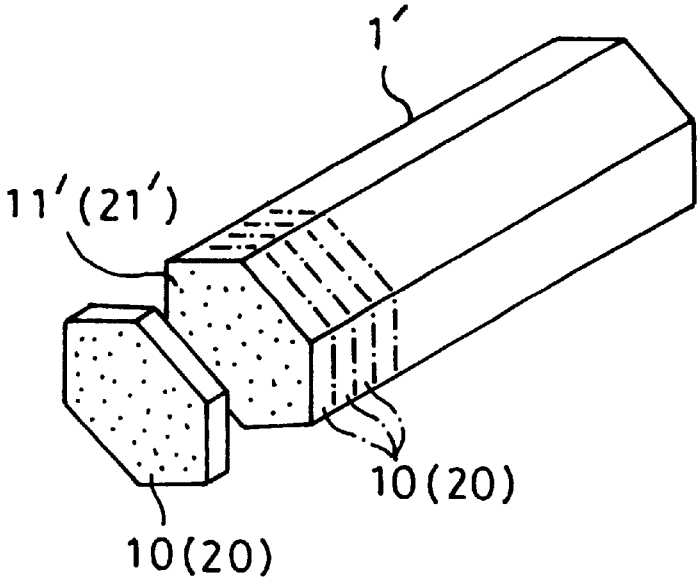
FIG. 12 is a perspective illustration of a polishing pad or a plate structure being cut.

In the preceding examples, the plate structures 10, 20 are formed by bonding together polishing elements, whose length is equivalent to the thickness thereof. The plate structures 10, 20 also may be made another way. As shown in FIG. 12, polishing elements 11' . . . of great length—the same as the polishing element 11 in shape (except for length)—or 21' . . . of great length—the same as the polishing element 21 in shape (except for length)—are bound together into a one piece or a bar-shaped, columnar structure 1' in the same way as in making the plate structures 10, 20. The bar-shaped structure 1' thus formed, a hexagonal structure, for example, is cut to a desired thickness to obtain a plurality of plate structures 10 . . . , 20 . . . . In this method, it is possible to make polishing pads 1 and plate structures 10, 20 in a large number efficiently. This method is very convenient in making a polishing pad of such a construction as shown in FIG. 11.

It is also noted that while in the preceding examples, plate structures 10, 20 are used in a one-layer structure form, the polishing pad may be formed of a plurality of layers placed one upon another, with the surface layer formed of the plate structures 10 or 20. For example, the first pad $1_1$ or the second pad $1_2$ may by built up, with base 10', 20' made of nonwoven fabrics or the like topped with plate structures 10, 20 (formed by bonding a plurality of plate structures as shown in FIG. 11), as indicated by chain line in FIGS. 3 and 4 or FIGS. 7 and 8.

As set forth above, the polishing pad of the present invention is identical in pore formation at any cross-section (including the pad surface), with the pores positioned and arranged in a regular pattern, and therefore can polish a work piece surface e.g. by CMP without presenting such problems as pointed out hereinabove.

What is claimed is:

1. A polishing pad comprising a large number of resin polishing elements, all tubular in shape with a very small diameter, the outer peripheral surfaces of adjacent resin polishing elements being fused or bonded to one another, with the axial direction tube end faces aligned on a plane to form a plate structure constituting the polishing pad surface and having pores regularly positioned and arranged in said plate structure and passing therethrough in the axial direction.

2. A polishing pad comprising a plurality of layers placed one upon another with one layer forming a surface layer, wherein said surface layer is formed of a plate structure as defined in claim 1.

3. A polishing pad comprising a large number of resin polishing elements with a very small diameter, all solid and columnar in shape, the outer peripheral surfaces of adjacent resin polishing elements being fused or bonded to one another, with the axial direction bar end faces aligned on a plane to form a plate structure, in such a way that gaps are formed as through pores in the axial direction between the outer peripheral surfaces, said through pores being regularly positioned and arranged in said plate structure.

4. A polishing pad comprising a plurality of layers placed one upon another with one layer forming a surface layer, wherein said surface layer is formed of a plate structure as defined in claim 3.

* * * * *